US005826452A

United States Patent [19]

Reichhardt

[11] Patent Number: 5,826,452

[45] Date of Patent: Oct. 27, 1998

[54] METHOD FOR THE MANUFACTURE OF A MACHINE PART WITH EXTERNAL TEETH

[75] Inventor: Hans Reichhardt, Ahlen, Germany

[73] Assignee: Leico GmbH & Co. Werkzeugmaschinenbau, Ahlen, Germany

[21] Appl. No.: 834,860

[22] Filed: Apr. 10, 1997

[30] Foreign Application Priority Data

May 3, 1996 [DE] Germany ..... 196 17 826.6

[51] Int. Cl.[6] ..... B21H 5/02

[52] U.S. Cl. ..... 72/69; 72/102; 29/893.32

[58] Field of Search ..... 72/69, 102, 108, 72/110; 29/893.32

[56] References Cited

U.S. PATENT DOCUMENTS 659,723 10/1900 Williams ..... 72/102
3,273,366 9/1966 Schuman ..... 72/69
3,745,851 7/1973 Zeldman et al. ..... 29/893.32
3,914,083 10/1975 Arai ..... 72/69

FOREIGN PATENT DOCUMENTS 804008 11/1958 United Kingdom ..... 72/69

*Primary Examiner*—Lowell A. Larson
*Attorney, Agent, or Firm*—Oblon, Spivak, McClelland, Maier & Neustadt, P.C.

[57] ABSTRACT

A method for the manufacture of a machine part with external teeth, particularly a starter ring or gear part, by spin forming of a circular blank and inductive heating which makes it possible to form high-quality tooth systems on an outer area of a cylindrical part. A circuit metal blank is fixed between chuck jaws in a spinning device and an end region is heated by at least one induction device and passes into a plastic state. Tools are then infed on either side of the chuck jaws and a forming operation, which includes material upsetting, is performed with a gear-cutting roll to form the external teeth. This is followed by induction heating of the teeth.

13 Claims, 3 Drawing Sheets

METHOD FOR THE MANUFACTURE OF A MACHINE PART WITH EXTERNAL TEETH

FIELD OF THE INVENTION

The invention relates to a method for the manufacture of a machine part with external teeth from a circular metal blank. Machine parts with external teeth are more particularly used in automotive and drive engineering, e.g. as a gear part or starter ring.

BACKGROUND OF THE INVENTION

DE-43 14 558 A1 discloses a method for the non-cutting manufacture of external teeth on a hollow cylindrical body from a plastically formable or shapable material, in which the starting workpiece is a ring with a rectangular cross-section. The ring is located in the interior of a hollow cylindrical device having internal teeth and is secured by an arm bracket. For the forming of the ring an inner roll is radially displaced and the ring is spun in the internal teeth accompanied by widening and the formation of external teeth on the outer circumference. Following the manufacture of the external teeth, the latter undergo hardening. Following further working the toothed ring is connected by welding to a plate, which forms the hub region of a gear part or starter ring.

Disadvantages of this method are long working times, high handling expenditure, a production of chips and the need for a quality control as a result of the weld in the welded parts. In addition, the life for the welded machine part does not meet the requirements, whilst in addition the weight is relatively high.

For the manufacture of a machine part with external teeth, German patent application 196 05 645.4 proposes fixing a circular metal blank between a tool and a tail stock and firstly to thicken and then flatten its circumference with the aid of a first and a second forming rolls. Subsequently, using a gear-cutting roll external teeth are applied to the thickened, flattened area. Then, outside the spinning machine, a mechanical working takes place, particularly a cutting of the edge and a hardening of the teeth.

The advantages of this method are that a clearly defined number of teeth can be obtained over a predeterminable circular metal blank diameter and there is no need for complicated synchronizing mechanisms for speed determination of workpiece and gear-cutting roll. As a cold deformation is performed, the method requires relatively high forces and the use of costly material for the tools used, in order to achieve an acceptable tool life.

SUMMARY OF THE INVENTION

The object of the invention is to provide an efficient spinning method, in which, whilst in particular avoiding specially constructed tools, particularly high quality rotationally symmetrical bodies with external teeth can be constructed.

According to the invention the problem is achieved by a method for the manufacture of a machine part with external teeth, particularly a starter ring or a gear part, by spin forming of a circular blank using inductive heating, characterized in that the circular blank is fixed in a spinning device between two chuck jaws, that a radial end region of the circular blank is heated to a predeterminable temperature with an induction device, which surrounds the radial end region, and in one zone is brought into a plastic state, that then tools are positioned on either side of the chuck jaws and a gear-cutting roll is radially infed accompanied by the formation of a recess and with an upsetting of the zone of the radial end region in a plastic state to a cylindrical area external teeth are formed on the cylindrical area.

The invention is based on the consideration that in one setting and a single forming movement, external teeth are to be formed on a rotationally symmetrical body and a machine part, particularly a starter ring, is to be manufactured with a particularly advantageous structure, whereby in the said one setting and at least prior to the forming movement there is a heating of a workpiece, at least in the area which is to be formed and provided with teeth.

Due to the fact that prior to forming and tooth cutting, which according to the invention are performed in one step, the starting form or workpiece is warmed or heated in a clearly defined area and transformed into a plastic state, in conjunction with specific tools radially a gear-cutting roll can be infed and performs the forming and gear-cutting in a single method step.

According to the invention the starting form or workpiece is a circular metal blank, which is fixed in a central area between two chuck jaws in a spinning machine or device. A radial end region of the circular blank is heated to a predeterminable temperature with the aid of an induction device, which is appropriately constructed in virtually complimentary manner to the radial end region of the circular blank and e.g. constitutes an induction shoe. The induction device or shoe is infed by means of a separate device.

By means of the induction device in the radial area of the workpiece an electromagnetic field is produced, accompanied by the formation of eddy currents, with a resulting temperature rise and plastic deformation of the area.

It is appropriate for the electromagnetic field to be a static field. Through the rotation of the circular blank in the static field, eddy currents are formed and a temperature increase obtained.

It is fundamentally possible to radially infeed an induction device and to direct it onto the circumferential area of a circular blank. It can be appropriate to provide several induction devices arranged in largely equidistantly spaced manner.

It is advantageous to control the heating of the radial area of the circular blank via the electromagnetic field and to adapt the material and dimensions of the circular blank to the gear rim geometry, etc.

According to the invention, after reaching a predeterminable temperature of the radial end region of the circular blank to be formed, the induction device is moved back or retracted and the tools are infed on either side of the central area of the blank. They are provided with recesses giving the subsequent shape of the toothing areas. Alternatively the toothing area can be defined by a correspondingly constructed gear-cutting roll, which e.g. has a recess formed by supporting disks to the left and right of a tooth system. Recesses in the tools are then not necessary. It is also possible both in the tools and in the gear-cutting roll to provide a recess, which together lead to the formation of the cylindrical area.

The toothing areas or parts of the machine part to be manufactured, e.g. a starter ring, are at right angles to the central area of the circular blank and form a cylindrical area. The cylindrical area can e.g. be formed on either side of a hub area and symmetrically, one-sided or both-sided and asymmetrically.

It is particularly advantageous to use telescopic tools which are infed on either side of the hub region of the circular blank. Subsequently a gear-cutting roll is inserted, which determines the construction of the gear rim. The gear-cutting roll is provided with external teeth, which in particular are formed over the entire end region. The dimensions of the end region of the gear-cutting roll correspond to the material accumulation to be formed in the recesses of the tools and lead with the material accumulation caused by upsetting to a formation of the teeth on a simultaneously formed cylindrical area.

It is particularly advantageous that following the construction of a cylindrical area with external teeth, the machine part can be removed and fitted. No reworking is required.

It is also advantageous to predetermine the forming of the radial end region of the hub to a cylindrical area with external teeth by the tools, particularly telescopic tools.

Appropriately the circular blank is so clamped and supported in its central region by the tools located on either side of the chuck, that the upsetting attained with the gear-cutting roll with the construction of a two-sided or one-sided cylindrical area with integrated gear rim can take place in one method step without disadvantageous consequences. For this purpose the radial area, which projects following the infeeding of the tools is so heated that a plastic deformation is possible.

In a method variant the additional tools, e.g. the telescopic tools are moved back again and the tooth system is hardened.

An induction hardening of the gear rim formed is advantageous and it is appropriate to use an induction device, which is largely adapted to the tooth system and to pass over the latter therewith and bring it to a temperature suitable for hardening. After retracting the induction device, it is appropriate to again infeed the telescopic tools and stabilize the starter ring. This is followed by rapid cooling, e.g. using water, to bring about hardening.

The tooth system can be constructed with a synchronized or also a non-synchronized gear-cutting roll.

In connection with the non-synchronized method reference is made to German patent application P 196 05 645.4, which in this connection is formed into part of the present application.

BRIEF DESCRIPTION OF THE DRAWINGS

The invention is described in greater detail hereinafter relative to the attached drawings, wherein show.

DESCRIPTION OF THE PREFERRED EMBODIMENT

Figure 1:
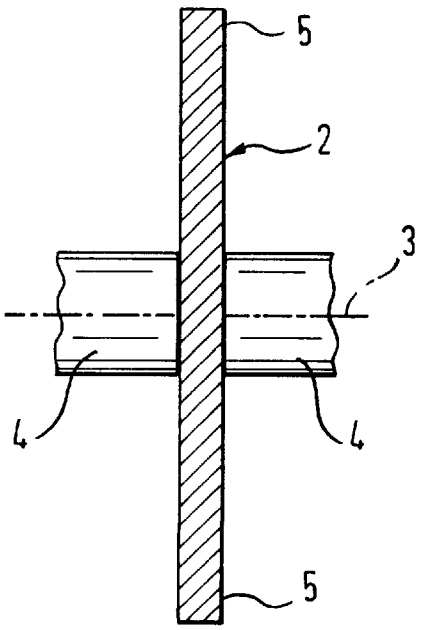
FIG. 1 A section through a circular metal blank held in a spinning device.

The inventive method for the manufacture of a machine part with external teeth, particularly a starter ring with transverse teeth, according to FIG. 1 is based on a circular metal blank 2. The latter is fixed in a spinning machine or device between two workpieces or chuck jaws 4 and rotates about an axis 3.

Figure 4:
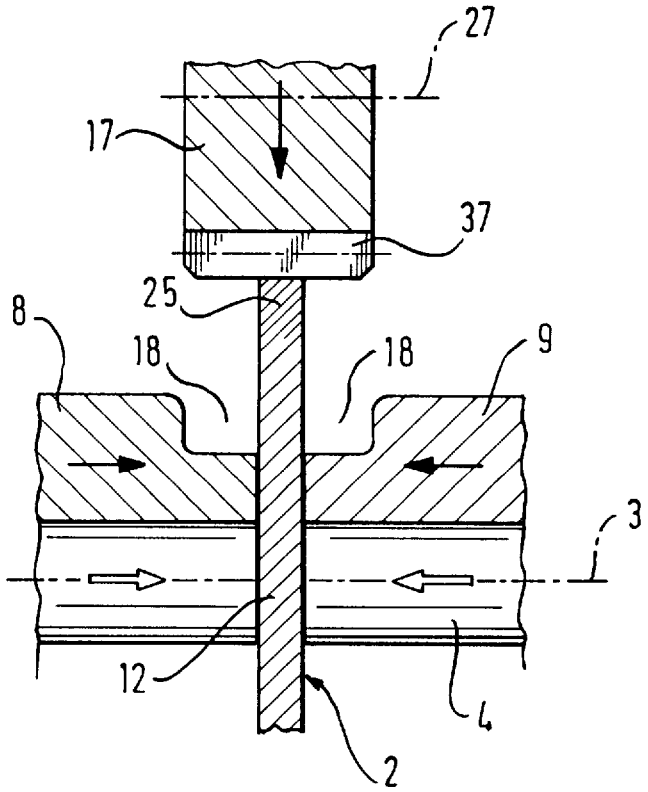
FIG. 4 A vertical partial section with a fixed circular blank and infed telescopic tool with recess and an end infed gear-cutting roll.

The circular metal blank 2 and chuck jaws 4 are so dimensioned that the blank projects radially over the chucks 4 with a radial end region 5. This radial end region 5, as can in particular be gathered from FIG. 4, is upset and simultaneously provided with external teeth.

Figure 2:
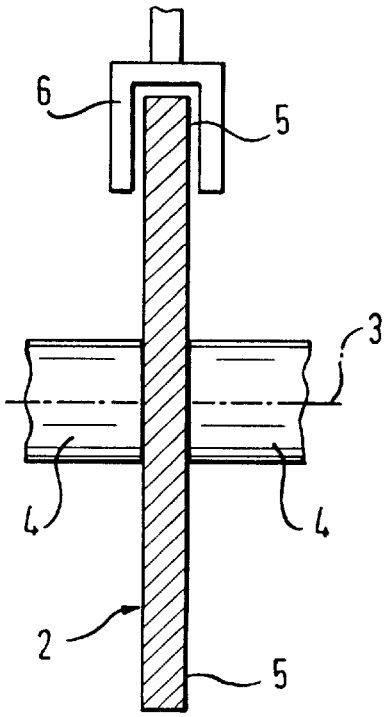
FIG. 2 A circular metal blank according to FIG. 1, which at its radial end region is heated by a radially infeedable induction device and plastically deformed.

To minimize the high forces required during said forming and external toothing, according to FIG. 2 at least one induction device 6 is directed onto the radial end region 5 of the circular blank 2 and an inductive heating of the blank 2 is performed in a clearly defined, outer area.

The induction device 6 has a shape adapted to the end region 5 of the circular metal blank 2 to be formed and is approximately U-shaped and largely engages round the radial end region 5 of the blank 2. The induction device 6, e.g. an induction shoe or an induction loop, also known as an inductor, can be constituted by a copper tube having a spacing of about 1 to 2 mm from the end region 5 of the circular metal blank 2. The induction device 6 induces alternating currents in the radial end region of the circular metal blank 2, which lead to a heat loss. The alternating or eddy currents and the associated temperature rise are substantially proportional to the intensity of the electromagnetic field. The field necessary for a given temperature can be established and/or experimentally determined. The electromagnetic field can either be an a.c. field or a static field, in which the eddy currents arise through the rotation of the workpiece within the field.

Figure 3:
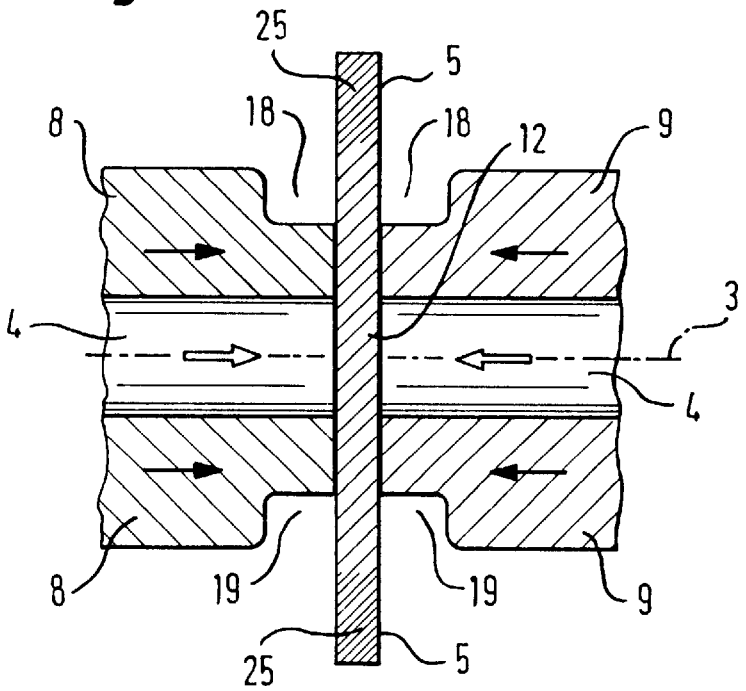
FIG. 3 A circular metal blank according to FIGS. 1 and 2 with heated, radially end region, which apart from the tools for fixing according to FIG. 1 is clamped by telescopic tools infed on both sides with a recess for the formation of a toothing part.

As a function of the material used, the induction device 6 causes the radial end region 5 to form a zone 25 with a plastic, deformable state (FIG. 3). Subsequently the induction device 6 is retracted and the tools 8, 9, particularly telescopic tools, are infed on either side of the centrally positioned chuck jaws 4. The telescopic tools 8, 9 largely engage on the chuck jaws 4 and clamp the sides of the blank 2 in a hub region 12. Radially outwards and directed towards the preheated end regions 5, the telescopic tools 8, 9 have recesses 18, 19, which predetermine the shape of the cylindrical area 15 to be formed (cf. FIGS. 5 to 7).

FIG. 3 shows recesses 18, 19 constructed in such a way that there is a symmetrical, cylindrical area 15. FIG. 3 indicates the heat treatment of the radial end region 5, which is in a plastic state in a zone 25.

With a single forming or shaping movement the radial end region in a plastic state 25 is formed in accordance with FIG. 4 and a cylindrical area 15 with external teeth 10 is constructed. This takes place with the aid of a gear-cutting roll 17 rotating about an axis 27 and having external teeth 37. The gear-cutting roll 17 is radially infed and has, as shown in FIG. 4, approximately the same width as the recesses 18 and 19 (not shown in FIG. 4). Due to the heated zone 25 of the outer, radial region 5 of the metal blank 2, lower forces are required for the forming of the radial end region 5 in a plastic state 25. Thus, no special material is required for the tools to be used.

Figure 5:
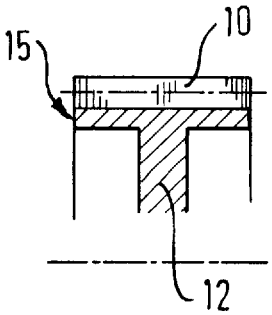
FIG. 5 A starter ring with a symmetrical, cylindrical area with external teeth.

It is particularly advantageous that the compression of the projecting, radial end region there is a not shown material accumulation filling the recesses 18, 19 and integrated into the upsetting is formed a tooth system 10 in an outer area (FIG. 5).

Figure 6:
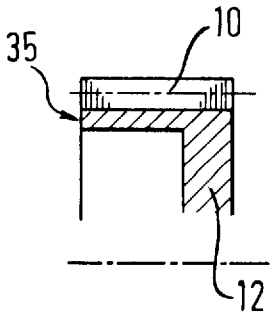
FIG. 6 A vertical partial section through a starter ring with a one-sided, cylindrical area with external teeth.
Figure 7:
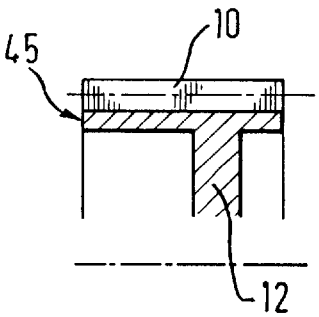
FIG. 7 A vertical partial section through a starter ring with an asymmetrical, cylindrical area and external teeth.

FIGS. 6 and 7 show other forms or shapes of the cylindrical area 15 of a starter ring, a gear part or some other machine part. FIG. 6 shows a one-sided, cylindrical area 35 with external teeth 10 and FIG. 7 an asymmetrical, cylindrical area 45 with external teeth 10. For the manufacture of the different shapes of the cylindrical area 15, 35, 45 it is possible to use telescopic tools with correspondingly constructed recesses. If the total width of the cylindrical area is the same, the gear-cutting rolls 17 can always be used.

According to an alternative method, a gear-cutting integrated into an upsetting is to be performed following clearly defined inductive heating of an outer, radial region 5 of a circular metal blank 2 with the aid of tools 8, 9 having no recess. However, a recess 32 is formed in a gear-cutting roll 22 to be radially infed.

Figure 8:
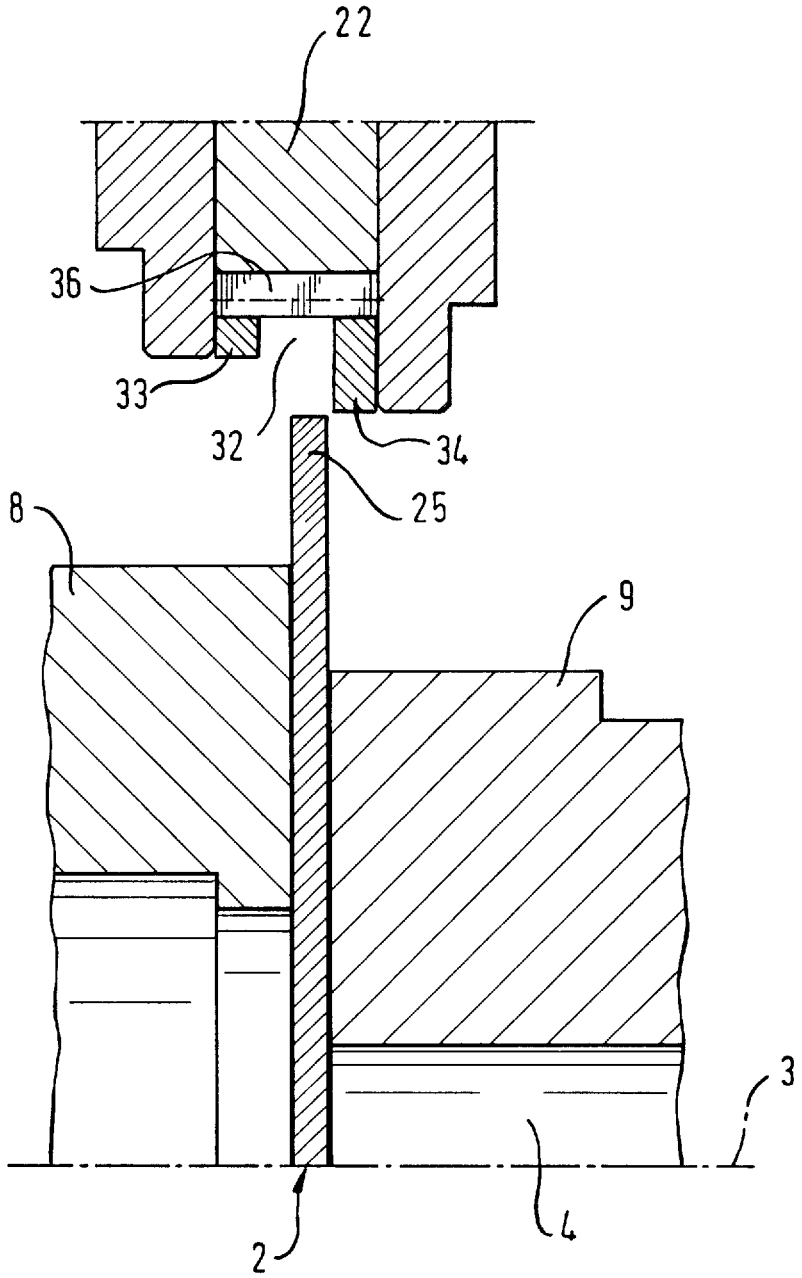
FIG. 8 A vertical partial section through a fixed circular metal blank with heated, radial end region and with a gear-cutting roll with recess.

FIG. 8 shows a gear-cutting roll 22 with a recess 32 prior to setting on a circular metal blank 2 or on a heated marginal zone 25 of said blank 2. In this case to the left and right of a tooth system 36 of the gear-cutting roll 22 there are supporting disks 33, 34, which project radially outwards and as a result of their arrangement, construction and dimensioning lead to a cylindrical area 35 with external teeth 10 shown in FIG. 6.

The method according to the invention provides a particularly efficient manufacturing procedure for a rotationally symmetrical body with external teeth. As a result of the planned, inductive heating and the formation of a plastic zone on the circumference of the circular metal blank used, it is possible with normal tools to obtain a material accumulation and the formation of a cylindrical area with external teeth in a single forming step.

I claim:

1. Method for the manufacture of a machine part with external teeth, particularly a starter ring or a gear part, by spin forming of a circular blank using inductive heating, characterized in that the circular blank is fixed in a spinning device between two chuck jaws, that a radial end region of the circular blank is heated to a predeterminable temperature with an induction device, which surrounds the radial end region, and in one zone is brought into a plastic state, that then tools are positioned on either axial side of the chuck jaws and a gear-cutting roll is radially infed accompanied by the formation of a recess and with an upsetting of the zone of the radial end region in a plastic state to a cylindrical area external teeth are formed on the cylindrical area.

2. Method according to claim 1, characterized in that the shape of the cylindrical area with external teeth is predetermined by tools, which have recesses, and/or a gear-cutting roll with a recess.

3. Method according to claim 1, characterized in that tools are provided, which outwardly and adjacent to the circular metal blank have recesses.

4. Method according to claim 1, characterized in that after positioning the tools on either side of the chuck jaws, a gear-cutting roll with a recess is infed for the formation of a cylindrical area with a tooth system.

5. Method according to claim 4, characterized in that a gear-cutting roll with supporting disks is infed on either side of a tooth system.

6. Method according to claim 1, characterized in that as tools telescopic tools are infed, which engage on the chuck jaws and clamp the circular metal blank in a hub region.

7. Method according to claim 1, characterized in that several induction devices are provided, which in particular are U-shaped and/or complimentary to the radial end region of the circular metal blank.

8. Method according to claim 1, characterized in that the recesses of the tools or the recess of the gear-cutting roll correspond to the cylindrical area to be formed, so that symmetrical, one-sided and/or asymmetrical, cylindrical areas are formed.

9. Method according to claim 1, characterized in that the telescopic tools are retracted after constructing the cylindrical area.

10. Method according to claim 1, characterized in that a further induction device with a construction corresponding to the tooth system is directed onto the latter and brings it to a temperature suitable for hardening the tooth system.

11. Method according to claim 1, characterized in that the tools are infed again for cooling the tooth system heated for induction hardening purposes.

12. A method for the manufacture of a machine part with external teeth, comprising the sequential steps of:

inductively heating a radial end region of a circular blank having a hub mounted to a spinning device until at least a portion of the radial end region is brought to a plastic state;

positioning tools against axial sides of the circular blank while forming a recess around the radial end region; and applying a gear cutting roll to the radial end region so as to deform the radial end region into a toothed cylindrical portion in said recess.

13. A method for the manufacture of a machine part with external teeth, comprising the sequential steps of:

mounting a hub of a circular blank to jaws of a spinning device while leaving axial sides of the circular blank radially outward from the jaws exposed;

inductively heating a radial end region of a circular blank having a hub mounted to a spinning device until at least a portion of the radial end region is brought to a plastic state, while leaving the axial sides of the circular blank exposed;

positioning tools against the axial sides of the circular blank while forming a recess around the radial end region; and applying a gear cutting roll to the radial end region so as to deform the radial end region into a toothed cylindrical portion in said recess.

* * * * *